US006966242B2

(12) United States Patent
Picone

(10) Patent No.: US 6,966,242 B2
(45) Date of Patent: Nov. 22, 2005

(54) ADJUSTABLE WRENCH WITH PRESET STOPS

(76) Inventor: John A. Picone, 2488 Arthur Ct., Oceanside, NY (US) 11572

( * ) Notice: Subject to any disclaimer, the term of this patent is extended or adjusted under 35 U.S.C. 154(b) by 0 days.

(21) Appl. No.: 10/726,646

(22) Filed: Dec. 4, 2003

(65) Prior Publication Data

US 2004/0144215 A1 Jul. 29, 2004

Related U.S. Application Data

(60) Provisional application No. 60/442,536, filed on Jan. 27, 2003.

(51) Int. Cl.[7] ..... B25B 13/16
(52) U.S. Cl. ..... 81/165; 170/185.1; 170/186
(58) Field of Search ..... 81/165, 170, 155, 81/185.1, 186

(56) References Cited

U.S. PATENT DOCUMENTS

| | | | | | |
|---|---|---|---|---|---|
| 1,403,059 | A | * | 1/1922 | Quigley | 81/186 |
| 1,828,561 | A | | 10/1931 | Garrison | |
| 1,942,492 | A | * | 1/1934 | Ratigan | 81/186 |
| 2,719,448 | A | * | 10/1955 | Bugge | 81/165 |
| 2,722,150 | A | * | 11/1955 | Green | 81/165 |
| 2,778,260 | A | | 1/1957 | Jovanovich | |
| 3,174,366 | A | | 3/1965 | Fuji | |
| 3,555,939 | A | * | 1/1971 | Halls | 81/165 |
| 3,858,466 | A | * | 1/1975 | Brunosson | 81/185.1 |
| 4,512,221 | A | | 4/1985 | Picone | |
| 5,062,328 | A | * | 11/1991 | Demurger | 81/186 |
| 5,331,868 | A | * | 7/1994 | Elmore | 81/165 |
| 5,485,641 | A | * | 1/1996 | Machmeier et al. | 81/186 |
| 5,579,667 | A | | 12/1996 | Kim | |
| 5,682,802 | A | | 11/1997 | Mazzone | |
| 5,806,383 | A | * | 9/1998 | Hsieh | 81/186 |
| 5,894,768 | A | * | 4/1999 | Malkin et al. | 81/165 |
| 6,279,429 | B1 | | 8/2001 | Boyer | |
| 6,477,921 | B1 | | 11/2002 | Picone | |
| 2003/0167886 | A1 | * | 9/2003 | Lin | 81/186 |

FOREIGN PATENT DOCUMENTS

DE 201 06 373 U1 8/2001

* cited by examiner

*Primary Examiner*—Debra S Meislin
(74) *Attorney, Agent, or Firm*—Berenato, White & Stavish

(57) ABSTRACT

An adjustable wrench comprising a moveable jaw, a stationary jaw, and a worm gear driving the moveable jaw. The worm gear is, in turn, meshed with a rack of the moveable jaw and is driven by a reversible servomotor. Activation of the servomotor produces linear reciprocating motion of the moveable jaw. The adjustable wrench further includes a positioning device provided for limiting a travel of the moveable jaw in at least one direction away from or toward the stationary jaw. Preferably, the positioning device includes a first preset stop for limiting a travel of the moveable jaw in the direction toward the stationary jaw to define an inward limit of travel of the moveable jaw and a second preset stop for limiting a travel of the moveable jaw the directions away from the stationary jaw to define an outward limit of travel of the moveable jaw.

27 Claims, 9 Drawing Sheets

ADJUSTABLE WRENCH WITH PRESET STOPS

CROSS-REFERENCE TO RELATED APPLICATION

This Application claims the benefit under 35 U.S.C. 119(e) of U.S. Provisional Application No. 60/442,536 filed Jan. 27, 2003 by John A. Picone.

BACKGROUND OF THE INVENTION

1. Field of the Invention

The present invention relates generally to wrenches and, more particularly, to an adjustable wrench having a sliding side jaw.

2. Description of the Prior Art

An powered adjustable wrench having a moveable jaw and a stationary jaw is known in the prior art. As illustrated in FIG. 1A, the powered adjustable wrench 1 of the prior art includes a wrench body having a wrench head 2 formed integrally with the stationary jaw 3 and the moveable jaw 4 adjustable relative to the stationary jaw 3. A worm gear 5 having a pulley 6 is rotated by a belt 7 and a motor pulley 8. The moveable jaw 4 is provided with an integral gear rack for engagement with the worm gear 5. The worm gear 5 is positioned between the fixed jaw 2 and the pulley 6. A double pole double throw (DPDT) switch 9 is used to control the opening and closing of the moveable jaw 4. With an upper handle housing removed, a bottom handle housing 10 houses an electric motor 12 connected to the motor pulley 8 by a shaft 13. Wires 14 and 15 connect the electric motor 12 with the DPDT switch 9 and batteries 16 supply power for the switch and motor. A sub mini jack 18 is used for recharging the batteries 16. The bottom handle housing 10 defines a battery recess 19 and a motor recess 20 containing the motor 12.

The moveable jaw 4 of the prior art, shown in FIG. 2, has a gear rack portion 4*a* including a toothed segment 4*b*. As illustrated in FIG. 2, a lead of a first tooth starts immediately at one distal end 4*c* of the gear rack portion 4*a*. Another distal end 4*d* of the gear rack portion 4*a* is not toothed. Such arrangement stops the worm gear 5 from movement in the direction away from the stationary jaw 3 and prevent the moveable jaw 4 from exiting out an open end of the wrench head 2. This, only one end of the gear rack portion 4*a* of the moveable jaw 4 is non-toothed to stop the outward movement of the moveable jaw 4.

The worm gear 5 of the prior art, shown in FIG. 3, includes a continuous screw thread 5*a* drivingly engaging teeth of the toothed segment 4*b* of the gear rack portion 4*a* of the movable jaw 4. Conventionally, the screw thread 5*a* has opposite start lead 5*b* and exit lead 5*c* that run out to opposite ends of the worm gear and gradually taper off.

As illustrated in FIG. 1B, the stationary jaw 3 has a jaw surface 3', while the movable jaw 4 has a jaw surface 4'. Thus, as further shown in FIG. 1B, the adjustable wrench 1 of the prior art grips a conventional hexagonal bolt head and/or nut 11 on two opposite sides thereof.

However, the powered adjustable wrenches of the prior art suffer certain drawbacks due to the fact that they rely on a motor torque to open and close its jaws 3, 4 and to stop the moveable jaw 4. In other words, the powered adjustable wrench 1 of the prior art relies on the motor 12 to stall in order to stop the moveable jaw 4. As was noted above, the prior art provides means for stopping the moveable jaw of the power wrench in only one direction, away from the stationary jaw (the full open position), in order to prevent the moveable jaw from exiting out the opened end of the wrench head. Wrenches of this type usually have rapid sliding jaw movement. However, a condition arises when the moveable jaw 4 is at full open position and then powered to the fully closed position. The rapid closing movement and inertia force of the moveable jaw 4 hammers and collides with the stationary jaw 3 to an abrupt stop, which creates the condition that locks-up the power wrench 1 between the moveable jaw 4 and the stationary jaw 3. The powered adjustable wrenches of the prior art do not have means to control positioning and stopping of the moveable jaw at predetermined stops for both open and close directions.

Furthermore, the adjustable wrench of the prior art grips the conventional hexagonal bolt head only on two opposite sides thereof.

SUMMARY OF THE INVENTION

The present invention is an improvement over the powered adjustable wrenches of the prior art disclosed in U.S. Pat. Nos. 4,512,221 and 6,477,921 incorporated herein by reference.

It is therefore an object of the present invention to provide a novel and improved adjustable wrench including a positioning device providing at least one preset stop in open or close direction in order to selectively limiting travel of the moveable jaw in one of the directions toward and away from the stationary jaw, and to eliminate a lock-up condition between a moveable jaw and a stationary jaw of the adjustable wrench.

In accordance with the preferred embodiment of the present invention, the powered adjustable jaw wrench includes a unitary single-piece body member having integral elongated handle portion and a head portion, a stationary jaw defined by the head portion, a movable jaw adjustable relative to the stationary jaw, actuated by a drive mechanism comprising a worm gear rotatably mounted in the head portion of the body member for advancing the movable jaw away from and toward the stationary jaw (open and close directions, respectively), and a power source drivingly coupled to the worm gear, and the positioning device providing two preset stops for selectively limiting travel of the moveable jaw in the directions both toward and away from the stationary jaw, and eliminating the lock-up condition between a moveable jaw and a stationary jaw of the adjustable wrench.

The preset stops of the positioning device include opposite first and second stop members provided on the worm gear, and opposite first and second stop members provided on the movable jaw complementary to the first and second stop members of the worm gear. In accordance with the preferred embodiment of the present invention, the first and second stop members of the worm gear are defined by first and second striker facets formed by substantially radially cutting start and exit leads of a screw thread of the worm gear, whereas the first and second stop members of the movable jaw are defined by opposite non-toothed segments of a gear rack portion of the movable jaw formed at distal ends of the gear rack portion.

The present invention allows to selectively locate the position of the preset stops in order to provide predetermined open and closing sizing. An advantage to the present invention is that multiple variations of the preset stops are achievable and the preset stops will provide the user a wrench that automatically sets to the most common sizes frequently used over and over. The precise selective location of the preset stops of the positioning device of the wrench of the present invention is achievable through accurate positional cuts of the worm leads defining the first and second striker facets in cooperation with the location of the non-toothed segments of the gear rack portion and selection of a number of teeth in the toothed segment of the moveable jaw.

The moveable jaw of the wrench in accordance with the present invention may be provided with a jaw insert utilized to protect integral jaw surfaces of the moveable jaw. The jaw insert may be secured to the jaw surfaces of the moveable jaw by any appropriate manner known in the art, such as flat head machine screws, ratchet fasteners, press fit pins, or the jaw insert and the pins can be molded into the moveable jaw by the injection molding process.

The worm gear of the wrench in accordance with the present invention is rotatably mounted in a head portion of a wrench body member on a non-threaded steel dowel pin. A plastic ratchet fastener is used to contain the dowel pin in the wrench head. Such an arrangement of the present invention allows quick assembling of the wrench by simply placing the slip fit dowel pin into a reciprocal hole in the wrench head and by inserting and press fitting the ratchet fastener to secure the dowel pin 64 within the wrench head.

Therefore, the adjustable wrench in accordance with the present invention includes a novel arrangement of the wrench including a positioning device provided for limiting a travel of the moveable jaw in at least one of the direction away from the stationary jaw and the direction toward the stationary jaw. It will be appreciated that the present invention is equally applicable to both powered and manually driven adjustable wrench.

BRIEF DESCRIPTION OF THE DRAWINGS

Other objects and advantages of the invention will become apparent from a study of the following specification when viewed in light of the accompanying drawings, wherein.

DETAILED DESCRIPTION OF PREFERRED EMBODIMENTS

The preferred embodiments of the present invention will now be described with the reference to accompanying drawings.

Figure 1A:
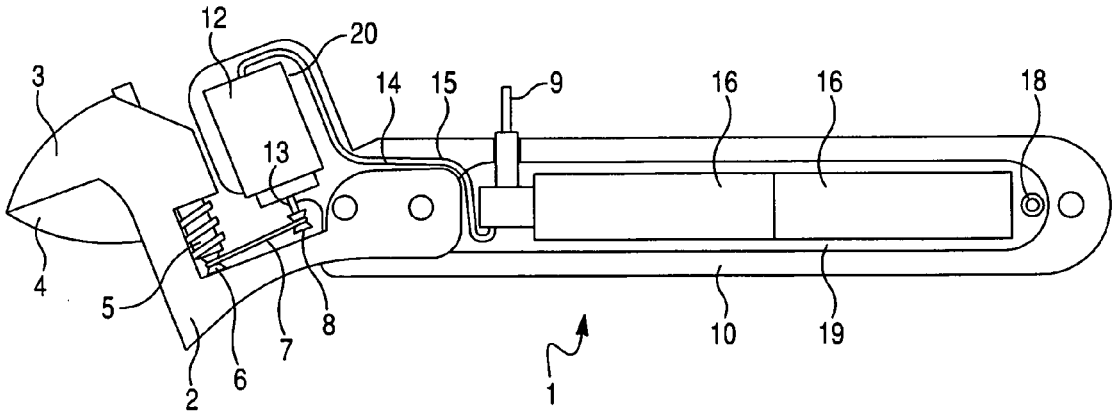
Fig. 1A Prior Art
FIG. 1A is a side view of a powered adjustable wrench of the prior art.
Figure 1B:
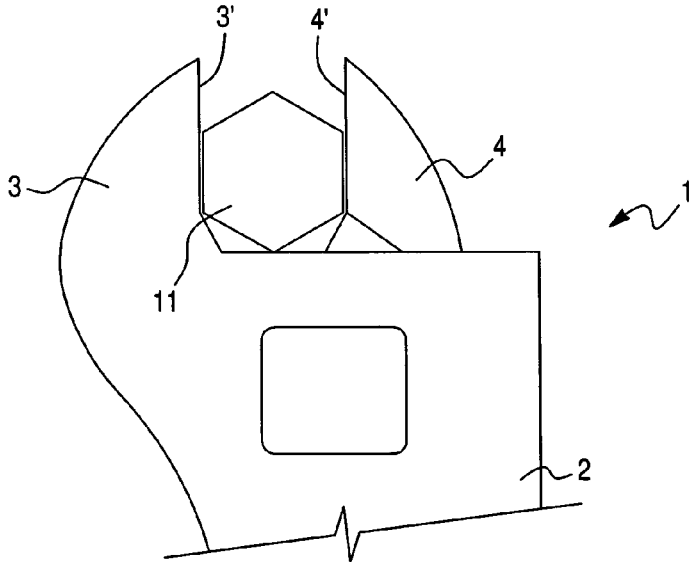
Fig. 1B Prior Art
FIG. 1B is a side view of the powered adjustable wrench of the prior art grasping a conventional hexagonal bolt head.
Figure 2:
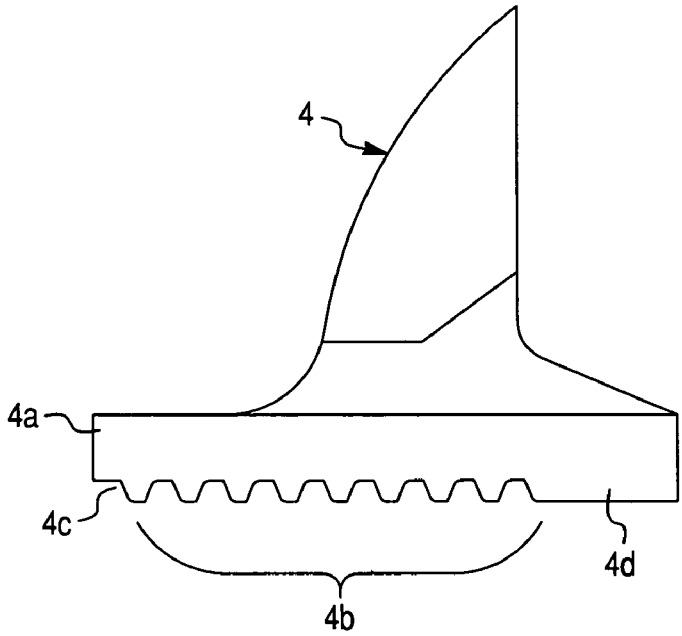
Fig. 2 Prior Art
FIG. 2 is a side view of a moveable jaw of the powered adjustable wrench of the prior art.
Figure 3:
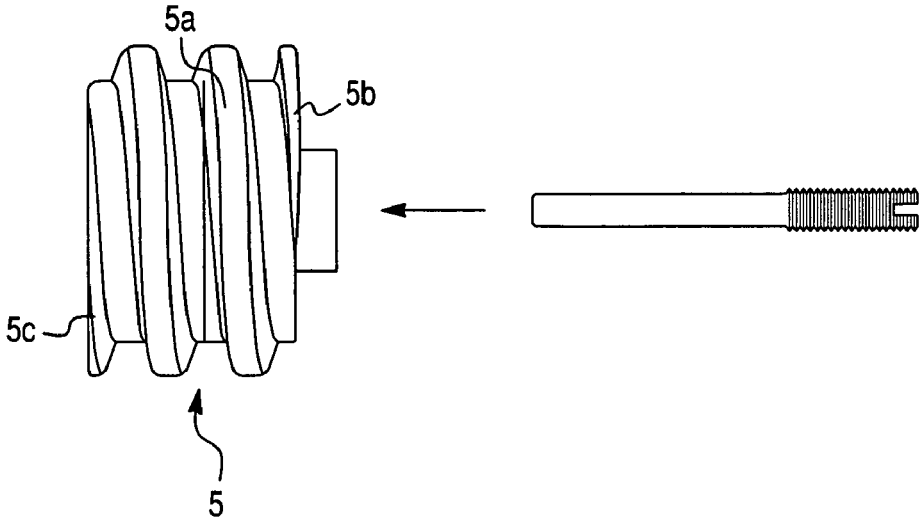
Fig. 3 Prior Art
FIG. 3 is a side view of a worm gear of the powered adjustable wrench of the prior art.
Figure 4:
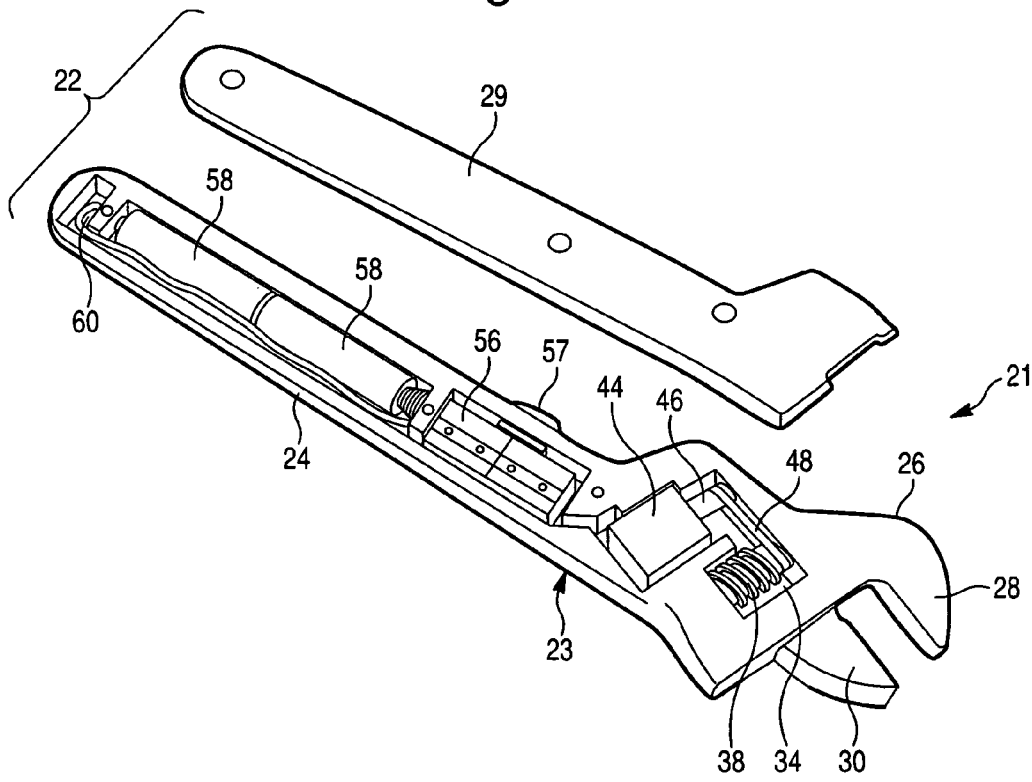
FIG. 4 is a perspective view of a powered adjustable wrench in accordance with the present invention.
Figure 5:
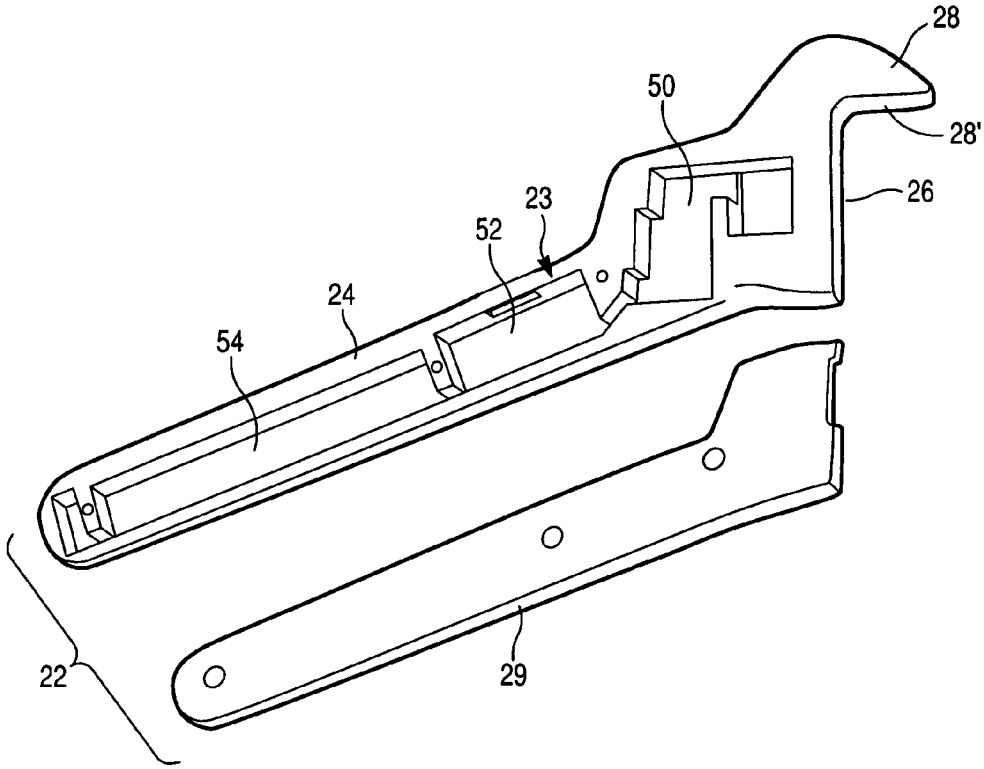
FIG. 5 is an exploded perspective view of a wrench body of the powered adjustable wrench in accordance with the preferred embodiment of the present invention.
Figure 8:
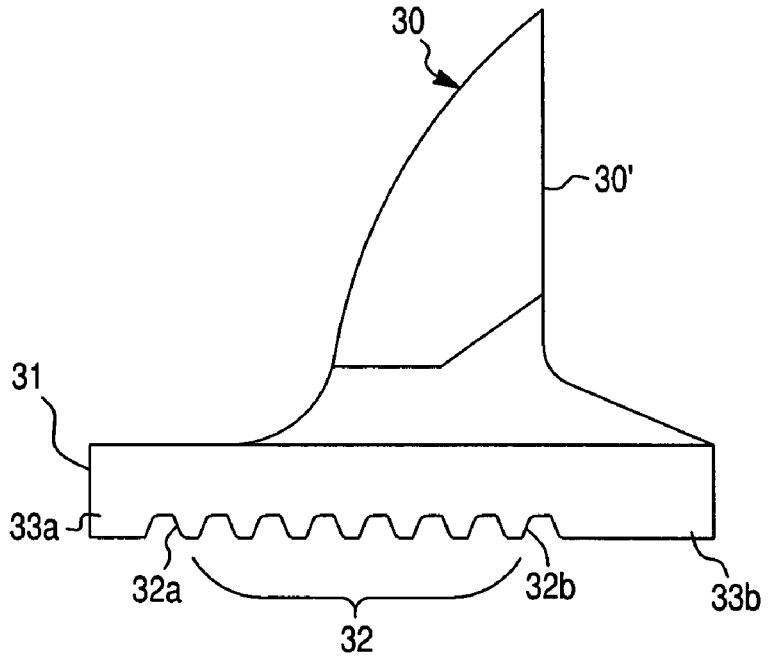
FIG. 8 is a side view of a first exemplary embodiment of a moveable jaw of the powered adjustable wrench in accordance with the present invention.

Referring now to FIG. 4, an improved powered adjustable wrench according to the preferred embodiment of the present invention is illustrated generally at 21 and comprises a wrench body 22 including a wrench body member 23 provided with a stationary jaw 28, and a handle cover 29 removably fastened to the wrench body member 23, and a movable jaw 30 adjustable relative to the stationary jaw 28. As illustrated in FIG. 5, the stationary jaw 28 has a jaw surface 28', while the movable jaw 30 has a jaw surface 30', as shown in FIG. 8.

The wrench body member 23 includes a handle portion 24 and a head portion 26. The stationary jaw 28 is integral to the head portion 26. Preferably, the handle portion 24 and the head portion 26 of the wrench body member 23, illustrated further in detail in FIG. 5, form a unitary single-piece part. It will be appreciated by those skilled in the art that the wrench body member 23 may be made of any appropriate material such as metal (steel, aluminum, etc.) or plastic material. The metal wrench body member 23 may be manufactured, preferably, of stainless steel by forging. However, any other appropriate methods for manufacturing the wrench body member 23 made of metal, such as die-casting or punching from a metal plate, are within the scope of the present invention. The plastic wrench body member is manufactured, preferably, by injection molding. However, any other appropriate methods for manufacturing the wrench body member 23 made of plastic material well known in the prior art, are within the scope of the present invention.

Figure 6:
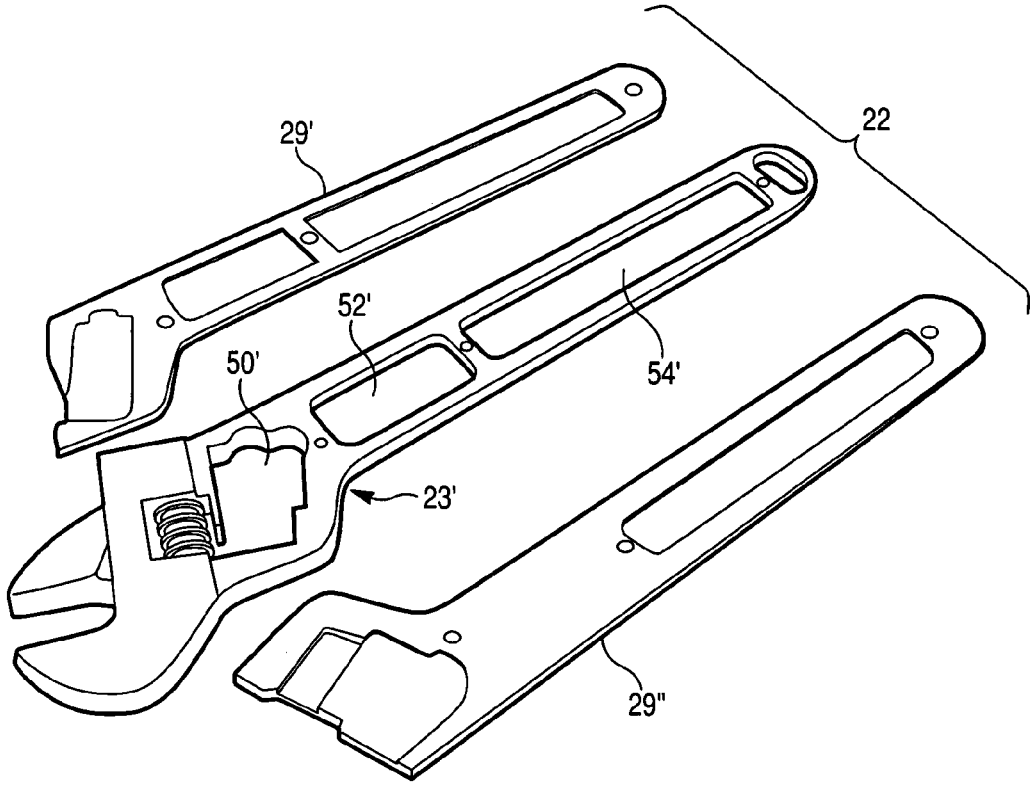
FIG. 6 is an exploded perspective view of the wrench body of the powered adjustable wrench in accordance with the alternative embodiment of the present invention.

According to the alternative embodiment of the present invention, illustrated in FIG. 6, the wrench body 22 includes a unitary single-piece wrench body member 23 and a pair of opposite handle covers 29' and 29" removably fastened to the wrench body member 23', preferably by bolts or screws.

The movable jaw 30 is reciprocally mounted to the head portion 26 of the body member 23 in alignment with the stationary jaw 28. Preferably, the movable jaw 30 in accordance with the first exemplary embodiment of the present invention is formed integrally with a gear rack portion 31 having a toothed segment 32, as shown in FIG. 8. As further shown in FIG. 8, first and last teeth 32, 32*b* of the toothed segment 32 of the gear rack portion 31 are substantially spaced further in from opposite distal ends of the gear rack portion 31, thus providing the gear rack portion 31 with opposite non-toothed segments 33*a* and 33*b* at the distal ends of the gear rack portion 31.

The powered adjustable wrench 21 according to the present invention further includes a drive mechanism comprising a worm gear 34 rotatably mounted in the head portion 26 of the wrench body member 23, and a power source provided for rotating the worm gear 34. The worm gear 34 is drivingly connected to the toothed rack 32 of the movable jaw 30 so that the rotatable movement of the worm gear 34 is transformed into the linear movement of the movable jaw 30.

Figure 9A:
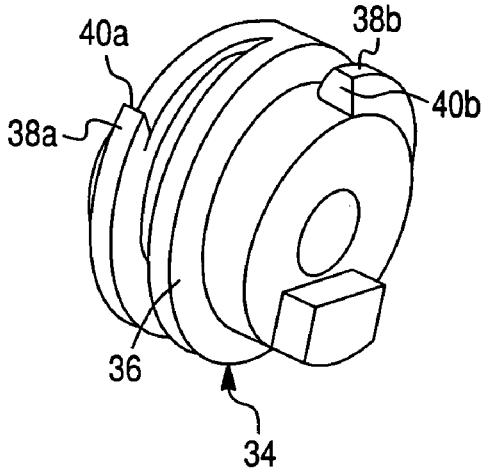
FIGS. 9A and 9B are perspective views of a worm gear of the powered adjustable wrench in accordance with the present invention.
Figure 9B:
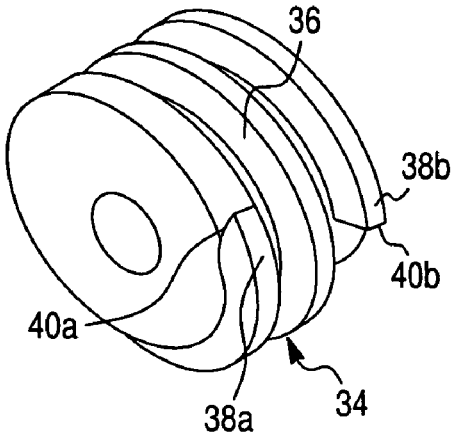

The worm gear 34 in accordance with the preferred embodiment of the present invention, illustrated in detail in FIGS. 9A and 9B, includes a helical screw thread 36 having opposite start and exit leads 38*a* and 38*b*, respectively. As further illustrated in FIGS. 9A and 9B, the start and exit leads 38*a*, 38*b* of the screw thread 36 of the worm gear 34 are cut substantially radially to form a first striker facet 40*a* and a second striker facet 40*b*.

In accordance with the preferred embodiment of the present invention, illustrated in FIG. 4, the power source of the drive mechanism comprises a reversible electric motor 44 mounted in the handle portion 24. The reversible electric motor 44 is employed for rotating the worm gear 34 through an endless toothed belt 48. Alternatively, the drive mechanism may include an endless chain instead of belt for rotating the worm gear 34. It will be appreciated by those skilled in the art that any other type of an endless torque-transmitting element known in the prior art is within the scope of the present invention.

Alternatively, instead of the electric motor, a fluid-pressure motor, such as pneumatic or hydraulic motor, may be employed as the power source. Pressurized fluid, such as pressurized gas (e.g. air or carbon dioxide), could be supplied to the fluid-pressure motor from an external source of the pressurized fluid (not shown). A fluid flow control valve including a valve actuator, have to be provided to control direction of rotation of the fluid-pressure motor. Or, a pressurized gas cartridge, such as $CO_2$ cartridge, (not shown), or a rechargeable pressurized gas storage tank (not shown), mounted in the handle portion of the power wrench, may be utilized. Gas under pressure may be charged into the storage tank through the gas fitting by external sources of the compressed gas, such as a hand pump, compressor, charging tanks or cartridges. Further alternatively, the power wrench may include a fluid-pressure turbine as the power source.

As further illustrated in FIG. 4, the electric motor 44 is electrically connected to a control switch assembly 56 including a switch actuator 57, controlling the motor 44 and at least one electric battery 58 supplying electric power to the motor 44 and the control switch assembly 56. Preferably, two batteries 58 are provided. The batteries 58 may be rechargeable. In this case, a sub mini jack 60 is used for recharging the batteries 58. The electric motor 44, the control switch assembly 56 and the electric battery 58 are disposed in compartments 50, 52 and 54 respectively, formed in the handle portion 24 of the wrench body member 23, as illustrated in FIG. 5. The handle cover 29 is adapted to seal the compartments 50, 52 and 54.

The wrench body member 23' in accordance with the alternative embodiment of the present invention (shown in FIG. 6) is provided with through openings 50', 52' and 54' housing the electric motor 44, the control switch assembly 56 and the electric battery 58, respectively.

Figure 7:
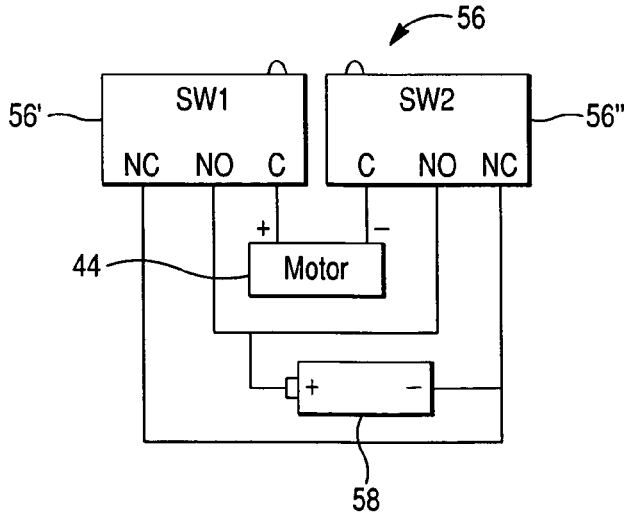
FIG. 7 is a schematic diagram of an electric circuitry for the powered adjustable wrench in accordance with the present invention.

It will be appreciated that any appropriate type of electrical switches known in the prior art may be utilized in the present invention, such as a double pole double throw (DPDT) switch. Preferably, the control switch assembly 56 includes a pair of single pole double throw (SPDT) switches 56' and 56" and the switch actuator 57, as shown in FIG. 7.

The powered adjustable wrench 21 according to the present invention further comprises a positioning device designed for limiting a travel of the moveable jaw 30 at least in the direction away from the stationary jaw 28, or in the direction toward the stationary jaw 28. Preferably, the positioning device limits the travel of the moveable jaw 30 in the directions both away from and toward the stationary jaw 28.

The positioning device, as illustrated in detail in FIGS. 8, 9A and 9B, includes at least preset stop for limiting the travel of the moveable jaw 30 in at least one direction: away from the stationary jaw 28 or toward the stationary jaw 28. Preferably, the positioning device includes two preset stops that limit the travel of the moveable jaw 30 in the directions both away from and toward the stationary jaw 28: a first preset stop for limiting the travel of the moveable jaw 30 in the direction toward the stationary jaw 28 to define an inward limit of travel of the moveable jaw 30 (a close position of the power wrench 21), and a second preset stop for limiting the travel of the moveable jaw 30 in the direction away from the stationary jaw 28 to define an outward limit of travel of the moveable jaw 30 (an open position of the power wrench 21).

The preset stops of the positioning device include opposite first and second stop members provided on the worm gear 34, and opposite first and second stop members provided on the movable jaw 30 complementary to the first and second stop members of the worm gear 34. In accordance with the preferred embodiment of the present invention, the first and second stop members of the worm gear 34 are defined by the first and second striker facets 40*a* and 40*b* respectively, as illustrated in FIGS. 9A and 9B, whereas the first and second stop members of the movable jaw 30 are defined by the non-toothed segments 33*a* and 33*b* respectively, of the gear rack portion 31 of the movable jaw 30, as illustrated in FIG. 8.

Geometrically, the stop members of the worm gear 34 and the movable jaw 30 are arranged so that the first stop member 40*a* of the worm gear 34 is adapted to engage the first complementary stop member 33*a* of the movable jaw 30 to limit the travel of the moveable jaw 30 in the direction toward the stationary jaw 28, while the second stop member 40*b* of the worm gear 34 is adapted to engage the second complementary stop member 33*b* of the movable jaw 30 to limit the travel of the moveable jaw 30 in the direction away from the stationary jaw 28. Thus, the combination of the first stop member 40*a* of the worm gear 34 and the first complementary stop member 33*a* of the movable jaw 30 defines the first preset stop, and the combination of the second stop member 40*b* of the worm gear 34 and the second complementary stop member 33*b* of the movable jaw 30 defines the second preset stop.

In operation, when the control switch assembly 56 actuates the electric motor 44 to move the moveable jaw 30 toward the close position, the reversible electric motor 44 rotates the worm gear 34 which, in turn, drives the moveable jaw 30 in the direction toward the stationary jaw 28. As the first stop member (the first striker facet 40*a*) of the worm gear 34 hits the first complementary stop member (the non-toothed segments 33*a* of the gear rack portion 31) of the movable jaw 30, the movable jaw 30 stops reaching its inward limit of travel and the power wrench is in the closed position. Similarly, when the control switch assembly 56 actuates the electric motor 44 to move the moveable jaw 30 toward the open position, the reversible electric motor 44 rotates the worm gear 34 which, in turn, drives the moveable jaw 30 in the direction away from the stationary jaw 28. As the second stop member (the second striker facet 40*b*) of the worm gear 34 hits the second complementary stop member (the non-toothed segments 33*b* of the gear rack portion 31) of the movable jaw 30, the movable jaw 30 stops reaching its outward limit of travel and the power wrench is in the open position.

Thus, the improved powered adjustable wrench of the present invention includes the positioning device that provides preset mechanical stops in both opening and closing directions and allow to eliminate a lock-up condition between the moveable jaw and stationary jaw.

Those skilled in the art would appreciate that the present invention allows to selectively locate the position of the preset stops in order to provide predetermined open and closing sizing. For instance, the power wrench can be configured to automatically stop at two preset positions, such as ⅝" and 1". The moveable jaw can freely move and be adjusted between those ⅝" and 1" preset positions. An advantage to the present invention is that multiple variations of the preset stops are achievable and the preset stops will provide the user a power wrench that automatically sets to the most common sizes frequently used over and over.

Figure 10:
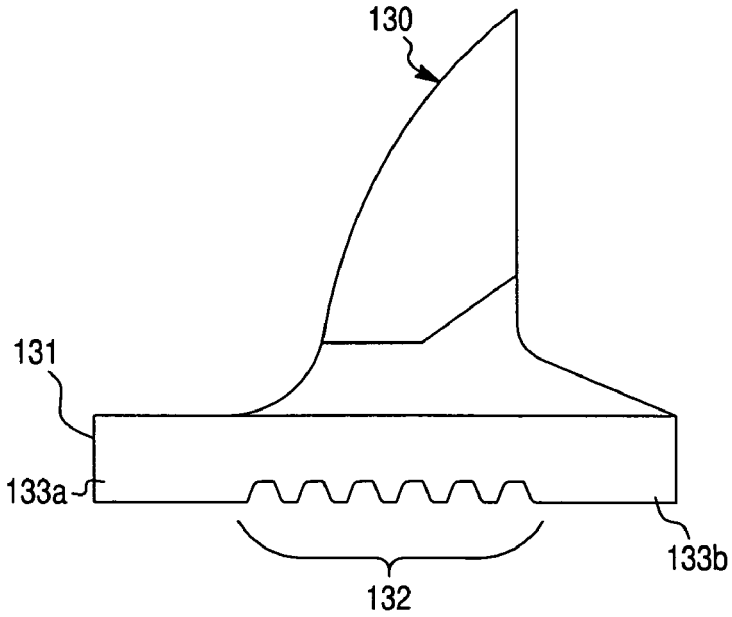
FIG. 10 is a side view of a second exemplary embodiment of the moveable jaw of the powered adjustable wrench in accordance with the present invention.

The precise selective location of the preset stops of the positioning device of the power wrench of the present invention is achievable through accurate positional cuts of the worm leads defining the first and second striker facets 40*a*, 40*b* in cooperation with the location of the non-toothed segments 33*a*, 33*b* of the gear rack portion 31 and selection of a number of teeth in the toothed segment 32 of the moveable jaw 30. For instance, the second exemplary embodiment of the moveable jaw generally indicated at 130 in FIG. 10, has a toothed segment 132 located centrally on a gear rack portion 131 so that opposite non-toothed segments 133*a* and 133*b* at the distal ends of the gear rack portion 131 are of equal size.

Figure 11A:
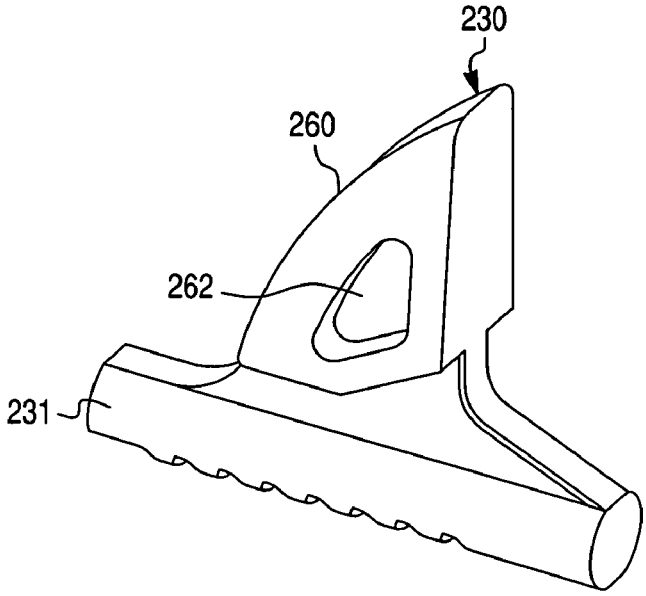
FIG. 11A is a perspective view of a third exemplary embodiment of the moveable jaw of the powered adjustable wrench in accordance with the present invention.
Figure 11B:
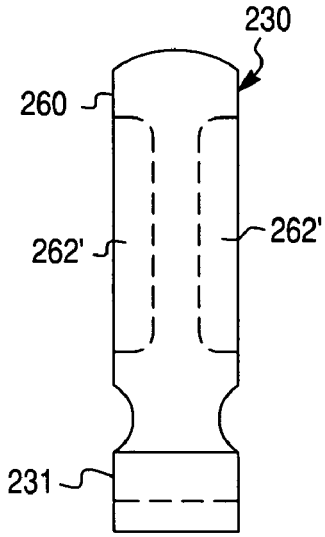
FIG. 11*b* is a cross-sectional view of a fourth exemplary embodiment of the moveable jaw of the powered adjustable wrench in accordance with the present invention.

FIG. 11A illustrates the third exemplary embodiment of the moveable jaw generally indicated at 230. The moveable jaw 230 is substantially similar to the moveable jaw 30 shown in FIG. 8, and includes a jaw head 260 and a gear rack portion 231. The jaw head 260 has a cored area in the form of an opening 262 through the jaw head 260. Alternatively, in accordance with the fourth exemplary embodiment of the moveable jaw, the cored area may be in the form of opposite relieves 262' formed on both side surfaces of the jaw head 260 of the moveable jaw 230, as illustrated in FIG. 11B. It will be appreciated by those skilled in the art that the cored areas aid in part stability when manufacturing processes of injection molding and/casting is performed. The cored areas also reduce the weight of the moveable jaw, thus conserving the energy for the power source and drive train of the powered adjustable wrench.

Figure 12B:
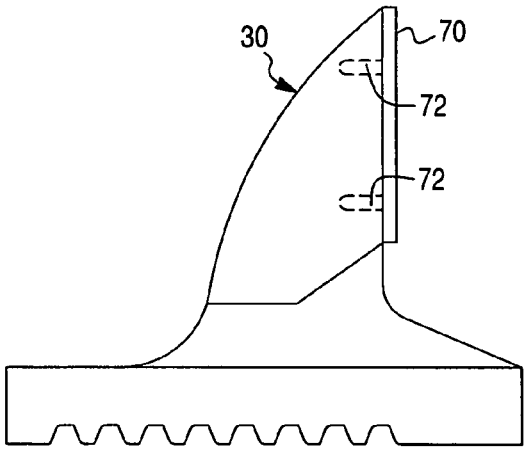
FIG. 12B is a side view of the moveable jaw with the jaw insert in accordance with the present invention.
Figure 12A:
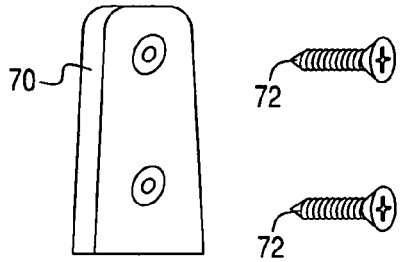
FIG. 12A is a perspective view of a jaw insert with fasteners in accordance with the present invention.

FIG. 12A shows a jaw insert 70 utilized to protect a jaw surface of the moveable jaw 30. As illustrated, two flat head machine screws 72 are utilized to fasten the jaw insert 70 to fasten to the jaw surface of the moveable jaw 30, as shown in FIG. 12B. Those skilled in the art would appreciate that the other appropriate types of fasteners, such as ratchet fasteners, may be employed to secure the jaw insert 70 to the jaw surfaces of the moveable jaw 30.

Figure 13A:
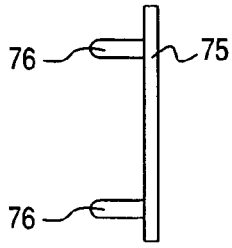
FIG. 13A is a perspective view of a jaw insert with fasteners in accordance with another embodiment of the present invention.
Figure 13B:
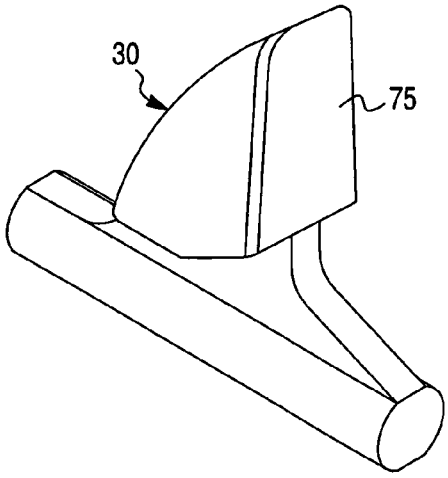
FIG. 13B is a side view of the moveable jaw with the jaw insert in accordance with another embodiment of the present invention.

In accordance with yet another embodiment of the present invention, as illustrated in FIGS. 13A and 13B, a jaw insert 75 is provided with integral pins 76. Consequently, the jaw insert 75 is mounted to the jaw surface of the moveable jaw 30 via the pins 76 by press fit. Alternatively, the jaw insert 75 and the pins 76 can be molded into the moveable jaw 30 by the insert injection molding process.

It will be appreciated by those skilled in the art that the jaw inserts (70 or 75) may also be used in the same manner on the stationary jaw 28. Thus, the jaw inserts can be adapted for use by both the moveable jaw 30 and stationary jaw 28 as needed.

The jaw inserts may be fabricated out of compatible materials such as plastic for soft jaws and metals for hard jaws depending on the particular application. Metal inserts that can be magnetized and be used to assist in picking up and holding a magnetic fastener or object. The jaw inserts may be fabricated with smooth non-marring faces, or with rough texture, or with teeth to aid in gripping a fastener or object.

Figure 14A:
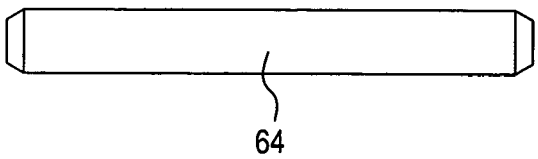
FIG. 14A is a side view of a dowel pin shaft supporting the worm gear in accordance with the present invention.
Figure 14B:
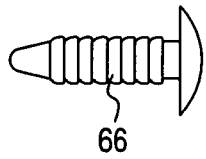
FIG. 14B is a side view of a ratchet fastener.
Figure 15:
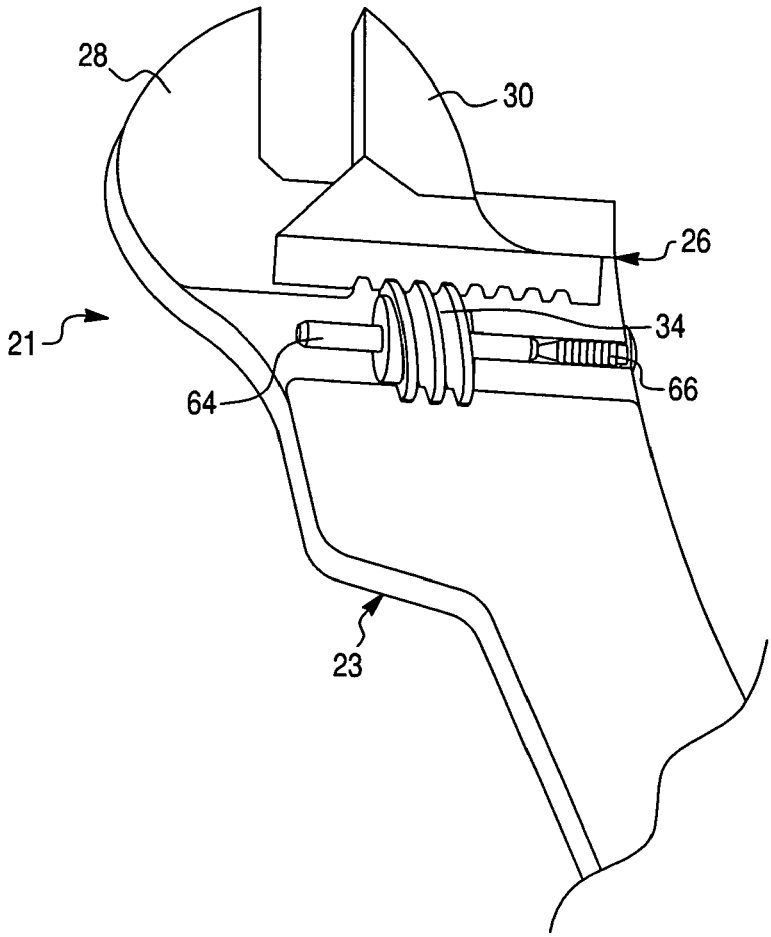
FIG. 15 is a partial perspective view of the power wrench of the present invention showing the worm gear mounted to the dowel pin shaft in a wrench head and retained therewithin by the ratchet fastener.

As illustrated in FIG. 15, the worm gear 34 is rotatably mounted on a stationary shaft. Preferably, the stationary shaft is in the form of a non-threaded steel dowel pin 64, shown in detail in FIG. 14A. The dowel pin 64 is non-rotatably mounted in the head portion 26 of the wrench body member 23, as shown in FIG. 15, to rotatably support some elements of the drive mechanism, such as the worm gear 34 and pulley or sprocket (not shown) engaging the endless belt 48. A fastener plug, preferably in the form of a plastic ratchet fastener 66, shown in detail in FIG. 14B, is used to contain the dowel pin 64 in the wrench head 26. Such an arrangement of the present invention allows quick assembling of the power wrench by simply placing the slip fit dowel pin 64 into a reciprocal hole in the wrench head 26 and by inserting and press fitting the ratchet fastener 66 to secure the dowel pin 64 within the wrench head 26. Thus, the present invention also provides quick and easy process of assembly and disassembly of the power wrench that eliminates the need to machine thread the worm gear shaft, machine thread the wrench head and machine a screw driver slot on the worm gear shaft.

Figure 16A:
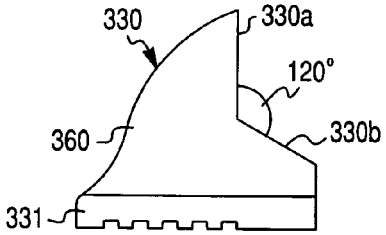
FIG. 16A is a side view of a fifth exemplary embodiment of the moveable jaw of the powered adjustable wrench in accordance with the present invention.
Figure 16B:
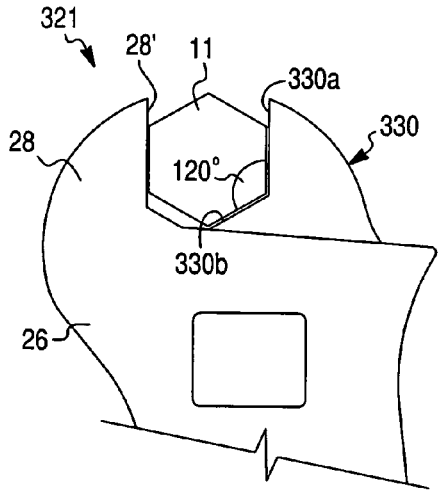
FIG. 16B is a partial side view of the powered adjustable wrench in accordance with the fifth exemplary embodiment of the present invention gripping a conventional hexagonal bolt head.

FIGS. 16A and 16B illustrate the fifth exemplary embodiment of an adjustable wrench generally indicated at 321, having a moveable jaw 330 and a stationary jaw 28 identical to the stationary jaw of the first exemplary embodiment of the present invention. The moveable jaw 330 is substantially similar to the moveable jaw 30 of the first exemplary embodiment of the present invention shown in FIG. 8, and includes a jaw head 360 and a gear rack portion 331. However, contrary to the moveable jaw 30 of the first exemplary embodiment of the present invention, the jaw head 360 has a jaw surface including two gripping segments

330*a* and 330*b* oriented with respect to each other substantially at an angle 120° that corresponds to the angle between adjacent sides of a conventional hexagonal bolt head and/or nut 11. Consequently, in operation, the moveable jaw 330 engages two sides of the hexagonal bolt head and/or nut 11, thus allowing the adjustable wrench 321 to grip three sides of the hexagonal bolt head and/or nut 11, as illustrated in FIG. 16B.

Figure 17A:
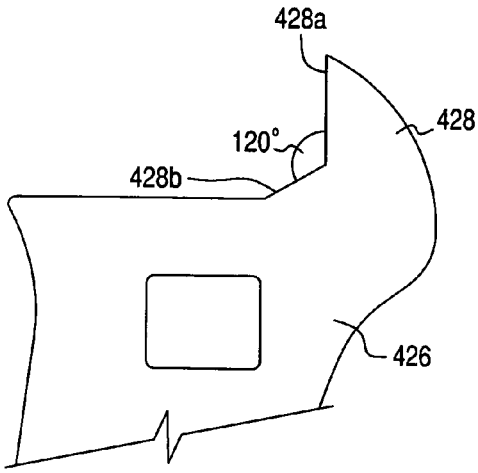
FIG. 17A is a side view of a wrench head of an adjustable wrench in accordance with a sixth exemplary embodiment of the present invention.
Figure 17B:
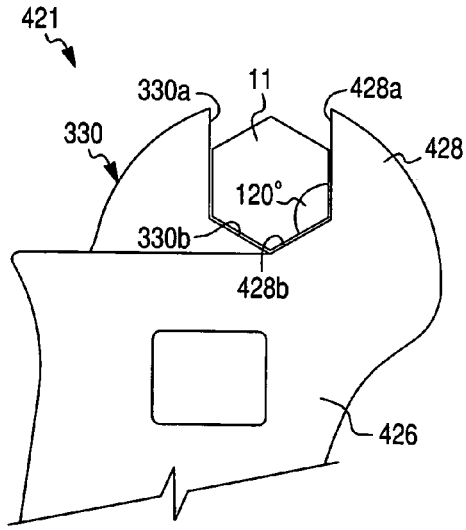
FIG. 17B is a partial side view of the powered adjustable wrench in accordance with the sixth exemplary embodiment of the present invention gripping the conventional hexagonal bolt head.

FIGS. 17A and 17B illustrate the sixth exemplary embodiment of an adjustable wrench generally indicated at 421, having a moveable jaw 330 identical to the stationary jaw of the fifth exemplary embodiment of the present invention and a stationary jaw 428 formed integrally with a head portion 426. The stationary jaw 428 is substantially similar to the stationary jaw 28 of the first exemplary embodiment of the present invention shown in FIGS. 4 and 5. However, contrary to the stationary jaw 28, the stationary jaw 428 has a jaw surface including two gripping segments 428*a* and 428*b* oriented with respect to each other substantially at an angle 120° that corresponds to the angle between adjacent sides of a conventional hexagonal bolt head and/or nut 11. Consequently, in operation, each of the moveable jaw 330 and the stationary jaw 428 engages two sides of the hexagonal bolt head and/or nut 11, thus allowing the adjustable wrench 421 to grip four sides of the hexagonal bolt head and/or nut 11, as illustrated in FIG. 17B.

Although the present invention is described in conjunction with the powered adjustable wrench, it will be appreciated that the present invention is equally applicable to a manually driven adjustable wrench.

Therefore, the powered adjustable wrench in accordance with the present invention includes a novel arrangement of the power wrench including a positioning device provided for limiting a travel of the moveable jaw in at least one of the direction away from the stationary jaw and the direction toward the stationary jaw.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. An adjustable wrench comprising:

a wrench body including a wrench body member having a handle portion and a head portion, said head portion defining a stationary jaw;

a movable jaw reciprocally mounted to said head portion of said body member in alignment with said stationary jaw, said movable jaw including a gear rack portion having a toothed segment;

a drive mechanism mounted to said head portion of said body member, said drive mechanism being operably connected to said movable jaw for selectively moving said movable jaw in directions away from and toward said stationary jaw, said drive mechanism including a worm gear rotatably mounted in said head portion of said body member, said worm gear having a screw thread drivingly engaging teeth of said toothed segment of said gear rack portion of said movable jaw; and a positioning device including at least one preset stop for limiting a travel of said moveable jaw in at least one of said direction away from said stationary jaw and said direction toward said stationary jaw, said at least one preset stop of said positioning device includes a stop member provided on said worm gear and a complementary stop member provided on said movable jaw so that said stop member of said worm gear is adapted to engage said complementary stop member of said movable jaw to limit said travel of said moveable jaw in at least one of said direction away from said stationary jaw and said direction toward said stationary jaw;

wherein said at least one stop member of said worm gear is formed on one of a start lead and an exit lead of said screw thread of said worm gear.

2. The adjustable wrench as defined in claim 1, wherein said at least one stop member of said worm gear is formed by substantially radially cutting one of said start lead and said exit lead of said screw thread of said worm gear to form a striker facet defining said at least one stop member of said worm gear.

3. The adjustable wrench as defined in claim 1, wherein said complementary stop member of said movable jaw is formed on said gear rack portion of said movable jaw outside said toothed segment.

4. The adjustable wrench as defined in claim 3, wherein said complementary stop member of said movable jaw is defined by an non-toothed segment of said gear rack portion adjacent to said toothed segment.

5. The adjustable wrench as defined in claim 1, wherein said positioning device includes a first preset stop for limiting said travel of said moveable jaw in said direction toward said stationary jaw to define an inward limit of travel of said moveable jaw and a second preset stop for limiting said travel of said moveable jaw in said direction away from said stationary jaw to define an outward limit of travel of said moveable jaw.

6. The adjustable wrench as defined in claim 5, wherein said preset stops of said positioning device include opposite first and second stop members provided on said worm gear and opposite first and second stop members provided on said movable jaw complementary to said first and second stop members of said worm gear so that said first stop member of said worm gear is adapted to engage said first complementary stop member of said movable jaw to limit said travel of said moveable jaw in said direction toward said stationary jaw and said second stop member of said worm gear is adapted to engage said second complementary stop member of said movable jaw to limit said travel of said moveable jaw in said direction away from said stationary jaw.

7. The adjustable wrench as defined in claim 6, wherein said first stop member of said worm gear is formed on a start lead of said screw thread of said worm gear and said second stop member of said worm gear is formed on an exit lead of said screw thread of said worm gear.

8. The adjustable wrench as defined in claim 7, wherein said first stop member of said worm gear is formed by substantially radially cutting said start lead of said screw thread of said worm gear to form a first striker facet defining said first stop member of said worm gear and said second stop member of said worm gear is formed by substantially radially cutting said exit lead of said screw thread of said worm gear to form a second striker facet defining said second stop member of said worm gear.

9. The adjustable wrench as defined in claim 6, wherein said complementary first and second stop members of said movable jaw are formed on said gear rack portion of said movable jaw outside said toothed segment.

10. The adjustable wrench as defined in claim 9, wherein said complementary first and second stop members of said movable jaw are defined by first and second non-toothed segments of said gear rack portion adjacent to opposite ends of said toothed segment.

11. The adjustable wrench as defined in claim 1, wherein at least one of said wrench body member, said worm gear and said moveable jaw is made of plastic material.

12. The adjustable wrench as defined in claim 1, wherein at least one of said wrench body member, said worm gear and said moveable jaw is made of metal.

13. The adjustable wrench as defined in claim 1, wherein said moveable jaw has a cored area in the form of an opening through a jaw head of said moveable jaw.

14. The adjustable wrench as defined in claim 1, wherein said moveable jaw has a cored area in the form of opposite relieves formed on both side surfaces of a jaw head of said moveable jaw.

15. The adjustable wrench as defined in claim 1, wherein at least one of said moveable jaw and said stationary jaw is provided with a jaw insert attached to a jaw surface of said moveable jaw.

16. The adjustable wrench as defined in claim 15, wherein said jaw insert is made of one of metal and plastic material.

17. The adjustable wrench as defined in claim 15, wherein said jaw insert is integrally molded with said moveable jaw.

18. The adjustable wrench as defined in claim 15, wherein said jaw insert is made of a magnetic material.

19. The adjustable wrench as defined in claim 15, wherein said jaw insert has a substantially smooth gripping surface.

20. The adjustable wrench as defined in claim 15, wherein said jaw insert has a substantially texturized gripping surface.

21. The adjustable wrench as defined in claim 1, further comprises a dowel pin mounted within said head portion of body member to support said worm gear and a fastener plug provided to contain said dowel pin in said wrench head.

22. The adjustable wrench as defined in claim 1, further comprises a power source mounted in said body member for driving said worm gear.

23. The adjustable wrench as defined in claim 1, wherein said moveable jaw has a jaw surface including two gripping segments oriented with respect to each other substantially at an angle 120° to facilitate engagement with one of a hexagonal bolt head and a hexagonal nut.

24. The adjustable wrench as defined in claim 1, wherein said stationary jaw has a jaw surface including two gripping segments oriented with respect to each other substantially at an angle 120° to facilitate engagement with one of a hexagonal bolt head and a hexagonal nut.

25. The adjustable jaw wrench as defined in claim 1, wherein said handle portion of said wrench body member defines an open cavity, said wrench body further including at least one handle cover removably secured to said handle portion of said wrench body member for closing said cavity.

26. The adjustable jaw wrench as defined in claim 25, wherein at least one of said wrench body member and said at least one handle cover is made of plastic material.

27. The adjustable wrench as defined in claim 15, wherein said jaw insert is attached to said jaw surface of said moveable jaw by one of a threaded fastener and press-fit connection.

* * * * *